US008060001B2

(12) United States Patent
Lee

(10) Patent No.: US 8,060,001 B2
(45) Date of Patent: Nov. 15, 2011

(54) FUSING UNIT AND IMAGE FORMING APPARATUS INCLUDING THE SAME

(75) Inventor: Seung-jun Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 627 days.

(21) Appl. No.: 12/172,425

(22) Filed: Jul. 14, 2008

(65) Prior Publication Data

US 2009/0067901 A1 Mar. 12, 2009

(30) Foreign Application Priority Data

Sep. 12, 2007 (KR) ..... 10-2007-0092488

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS 5,499,087 A * 3/1996 Hiraoka et al. ..... 399/329
6,597,888 B1 * 7/2003 Abe et al. ..... 399/329

FOREIGN PATENT DOCUMENTS

JP 8-248791 9/1996

* cited by examiner

*Primary Examiner* — David Gray
*Assistant Examiner* — Gregory H Curran
(74) *Attorney, Agent, or Firm* — Staas & Halsey LLP

(57) ABSTRACT

A fusing unit, and an image forming apparatus including the same, includes: a driving roller; a belt disposed to be driven by the driving roller; a nip plate disposed along a lengthwise direction of the driving roller with the belt being disposed between the driving roller and the nip plate, the nip plate being pressed toward the driving roller to form a fusing nip; a heat radiating body disposed along the lengthwise direction to heat the nip plate by heat conduction; and a heat radiating body pressing member to press the heat radiating body toward the nip plate to prevent the heat radiating body from being spaced from the nip plate due to thermal deformation. The image forming apparatus includes: an image forming unit to form an image on a printing medium with a developer; and the fusing unit.

19 Claims, 13 Drawing Sheets

FUSING UNIT AND IMAGE FORMING APPARATUS INCLUDING THE SAME

CROSS-REFERENCE TO RELATED APPLICATIONS

This application claims the benefit of Korean Patent Application No. 2007-92488, filed on Sep. 12, 2007, in the Korean Intellectual Property Office, the disclosure of which is incorporated herein by reference.

BACKGROUND OF THE INVENTION

1. Field of the Invention

Aspects the present invention relate to a fusing unit and an image forming apparatus including the same, and more particularly, to a fusing unit that can minimize thermal deformation of a heat radiating body to enhance fusing efficiency, and an image forming apparatus including the same.

2. Description of the Related Art

In general, a fusing unit is employed in an image forming apparatus to form an image on a printing medium. The fusing unit applies heat and pressure to the printing medium to which a developer is applied to fuse the developer on the printing medium.

The fusing unit may be classified as a roller type, which includes a heating roller and a pressing roller, and a belt type, which includes a pressing belt and an endless belt driven by the pressing belt. The roller type employs the heating roller, which has a large thermal capacity and takes much time to be heated by an internal heat source and is therefore suitable for high speed printing. Contrarily, the belt type employs the endless belt which has a small thermal capacity and is suitable for high speed printing. Further, the belt type has a superior thermal efficiency. Recently, the belt type has been actively under development.

As shown in FIGS. 1 and 2, a conventional fusing unit 1 of the belt type includes a pressing roller 10, a belt 20 which is driven by the pressing roller 10, a pair of bushings 70 which rotatably supports opposite end parts of the belt 20, a nip plate 40 which is disposed opposite to the pressing roller 10 with the belt 20 being disposed therebetween and forms a fusing nip N, and a heat radiating body 30 which is disposed in a lengthwise or axial (X) direction of the nip plate 40 and contacts the nip plate 40 to heat the nip plate 40. The belt 20 is guided by a belt guide 50 and the heat radiating body 30 and the nip plate 40 are disposed in the belt guide 50.

As shown in FIG. 2, the bushings 70 are elastically pressed toward the pressing roller 10 by an elastic member 60, and accordingly, the nip plate 40 supported by the bushings 70 is also pressed toward the pressing roller 10. The heat radiating body 30 includes a ceramic substrate and a heat radiating pattern which is formed on the ceramic substrate. The heat radiating pattern is provided on a side of the ceramic substrate opposite the nip plate 40. The nip plate 40 is made of metal so that heat from the heat radiating body 30 can be evenly conducted along the lengthwise (X) direction thereof.

FIG. 3A is a graph showing deflection of the heat radiating body 30 and the nip plate 40 in the lengthwise (X) direction. Here, E1 and E2 represent opposite end parts of the heat radiating body 30; and C represents a center part thereof. The nip plate 40 is thermally deformed, which is represented as a solid line A in FIG. 3A, due to the pressing of the opposite end parts thereof by the bushings 70 and the heat conduction from the heat radiating body 30. On the other hand, the heat radiating body 30 radiates heat as power is supplied to the heat radiating pattern, and thus, is thermally deformed, which is represented as a dotted line B in FIG. 3A.

Accordingly, the nip plate 40 and the heat radiating body 30 tend to get close to each other at the center parts (C) thereof and tend to be spaced from each other at the opposite end parts (E1 and E2) thereof. Although the nip plate 40 and the heat radiating body 30 are adhered by an adhesive, heat conductivity from the heat radiating body 30 to the nip plate 40 decreases at the opposite end parts (E1 and E2) by repetitive thermal deformation of the heat radiating body 30. Such phenomenon is illustrated FIG. 3B which is a curve showing temperature distribution of the heat radiating body 30. As shown in FIG. 3B, the temperature of the opposite end parts (E1 and E2) of the heat radiating body 30 is 240° C., which is higher than the temperature of the center part (C) thereof, which is 200° C. The temperature difference between the opposite end parts (E1 and E2) is due to the adhesive force between the heat radiating body 30 and the nip plate 40 weakening at the opposite end parts (E1 and E2); and thus, the heat conduction is decreased at the opposite end parts (E1 and E2) compared to the center part (C). As such, the opposite end parts (E1 and E2) of the heat radiating body 30 are overheated, whereas the center part (C) maintains a normal temperature, which is about 200° C.

As a result, the temperature of the opposite end parts (E1 and E2) of the nip plate 40 is lower than that of the center part (C) thereof, which is the same in the belt 20 which is heated by the nip plate 40. Accordingly, the fusing efficiency decreases at the opposite end parts of the belt 20 where the temperature is relatively low compared with the center part, thereby decreasing the printing quality. Further, the non-uniform temperature along the lengthwise (X) direction causes a limit to an arrangement of a temperature sensor or requires multiple temperature sensors to prevent overheating of the fusing unit.

SUMMARY OF THE INVENTION

Accordingly, an aspect of the present invention provides a fusing unit which can uniformly maintain an adhesive force between a heat radiating body and a nip plate, and an image forming apparatus including the same. Another aspect of the present invention provides a fusing unit which can minimize thermal deformation of a heat radiating body, and an image forming apparatus including the same. Still another aspect of the present invention provides a fusing unit which can uniformly maintain fusing temperature along a lengthwise direction thereof, and an image forming apparatus including the same. Yet another aspect of the present invention provides a fusing unit which can enhance the printing quality, and an image forming apparatus including the same.

Additional aspects of the present invention will be set forth in part in the description which follows and, in part, will be obvious from the description, or may be learned by practice of the present invention.

Aspects of the present invention provide a fusing unit including: a driving roller; a belt which disposed to be driven by the driving roller; a nip plate disposed along a lengthwise direction of the driving roller with the belt disposed between the driving roller and the nip plate, the nip plate being pressed toward the driving roller to form a fusing nip; a heat radiating body disposed along the lengthwise direction to heat the nip plate by heat conduction; and a heat radiating body pressing member to press the heat radiating body toward the nip plate to prevent the heat radiating body from being spaced from the nip plate due to thermal deformation.

According to an aspect of the present invention, the heat radiating body pressing member may press the heat radiating body with different pressing forces along the lengthwise direction corresponding to thermal deformation of the heat radiating body and the nip plate along the lengthwise direction.

According to an aspect of the present invention, the heat radiating body pressing member may include: a pressing part to elastically press the heat radiating body toward the nip plate; and a supporting part disposed opposite the heat radiating body from the nip plate to support the pressing part with the pressing part being disposed between the nip plate and the supporting part.

According to an aspect of the present invention, the heat radiating body pressing member may differ along the lengthwise direction in at least one of thickness, elastic modulus, or material. According to an aspect of the present invention, the heat radiating body pressing member may include at least one of sponge, rubber, or a spring.

According to an aspect of the present invention, the fusing unit may further include: a bushing to rotatably support the belt and supports the heat radiating body pressing member; and a bushing pressing member to elastically press the bushing toward the driving roller.

According to an aspect of the present invention, the fusing unit may further include a heat insulating member disposed between the supporting part and the heat radiating body to prevent heat from the heat radiating body from being transferred to the supporting part.

Aspects of the present invention provide an image forming apparatus including: an image forming unit to form an image on a printing medium with a developer; and the above-described fusing unit to fuse the image on the printing medium.

According to an aspect of the present invention, the heat radiating body pressing member may press the heat radiating body with different pressing forces along the lengthwise direction corresponding to thermal deformation of the heat radiating body and the nip plate along the lengthwise direction.

According to an aspect of the present invention, the heat radiating body pressing member may include: a pressing part to elastically press the heat radiating body toward the nip plate; and a supporting part disposed opposite to the heat radiating body from the nip plate with the pressing part being disposed between the heat radiating body pressing member and the nip plate.

According to an aspect of the present invention, the heat radiating body pressing member may differ along the lengthwise direction in at least one of thickness, elastic modulus, or material along the lengthwise direction. According to an aspect of the present invention, the heat radiating body pressing member may include at least one of sponge, rubber, or a spring.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF THE EMBODIMENTS

Figure 1:
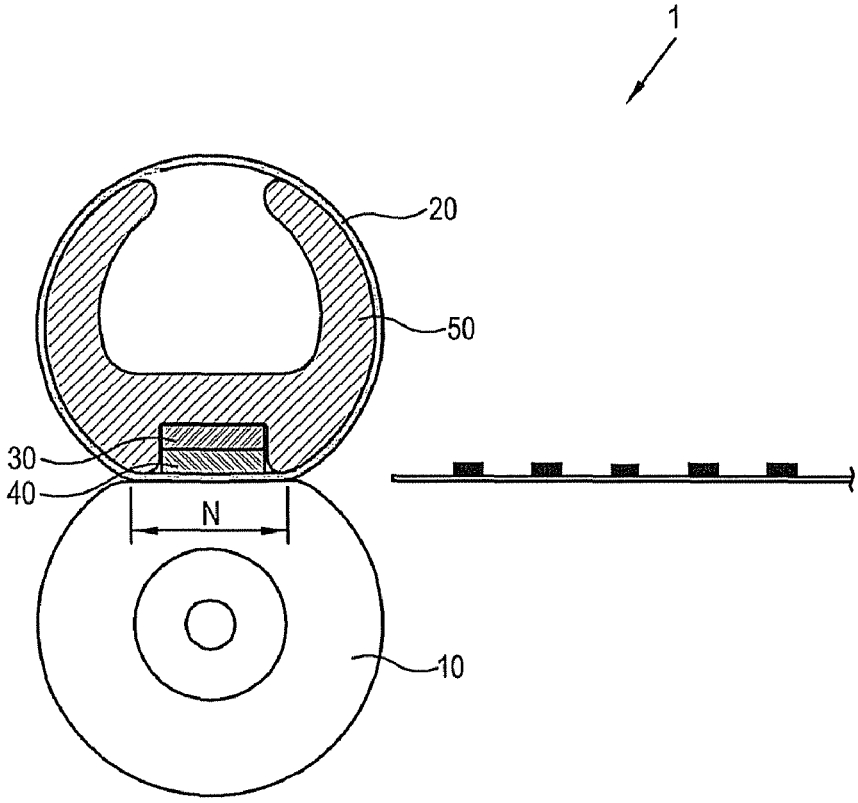
FIG. 1 (RELATED ART)
FIG. 1 is a cross section view illustrating a conventional fusing unit.
Figure 2:
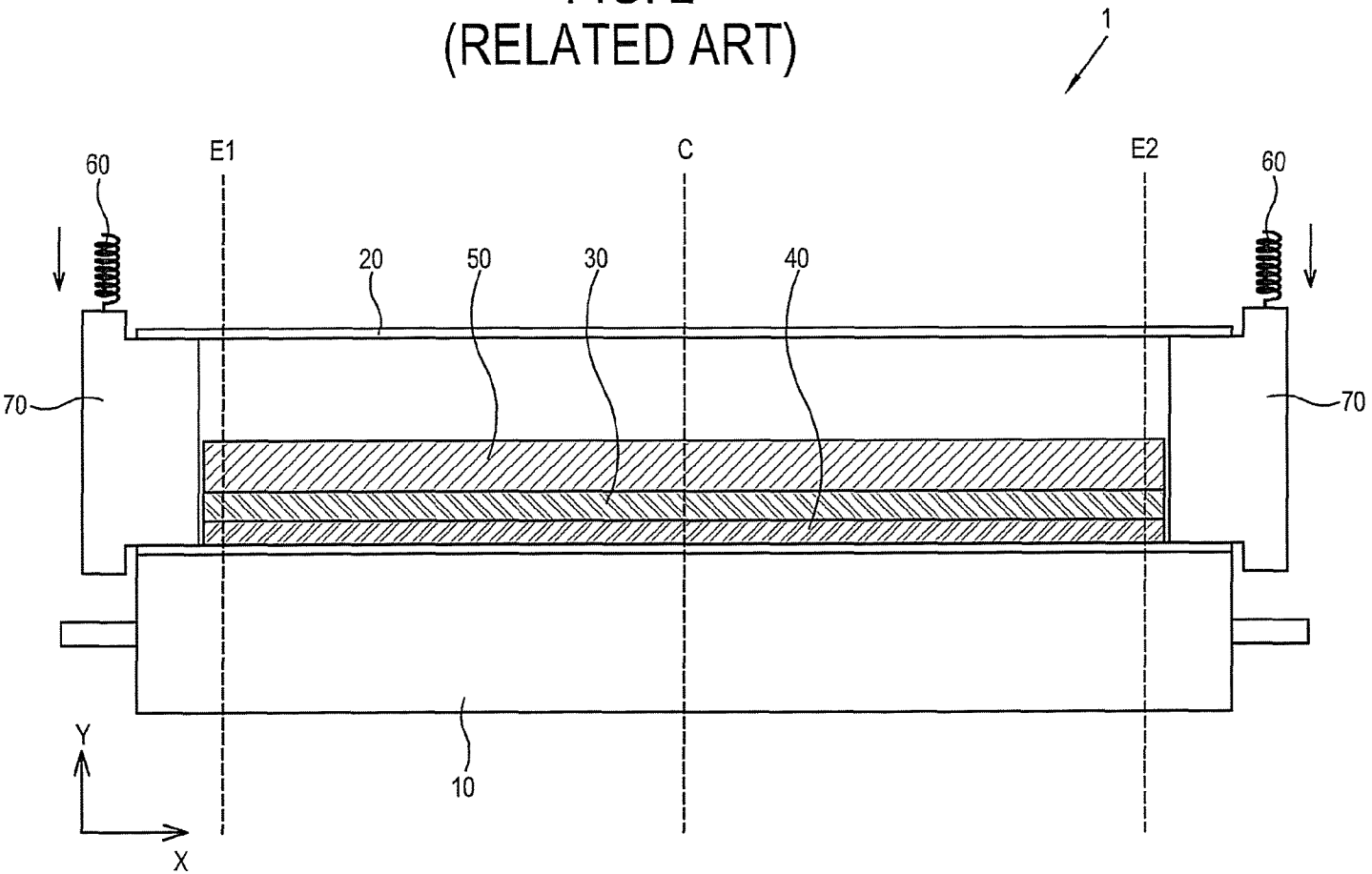
FIG. 2 (RELATED ART)
FIG. 2 is a longitudinal section view illustrating the conventional fusing unit.

Reference will now be made in detail to the embodiments of the present invention, examples of which are illustrated in the accompanying drawings, wherein like reference numerals refer to like elements throughout. The exemplary embodiments are described below so as to explain the aspects of the present invention by referring to the figures.

Figure 4:
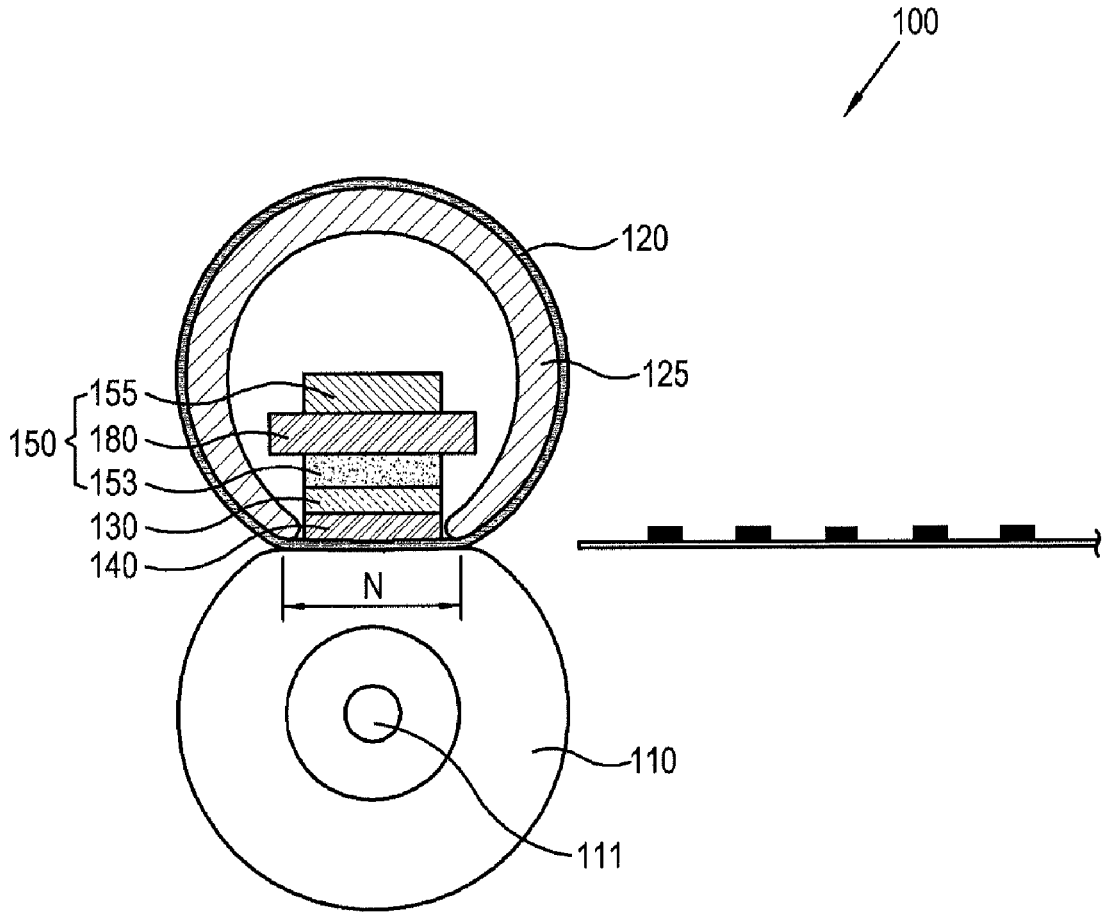
FIG. 4 is a cross section view of a fusing unit according to an embodiment of the present invention.
Figure 5:
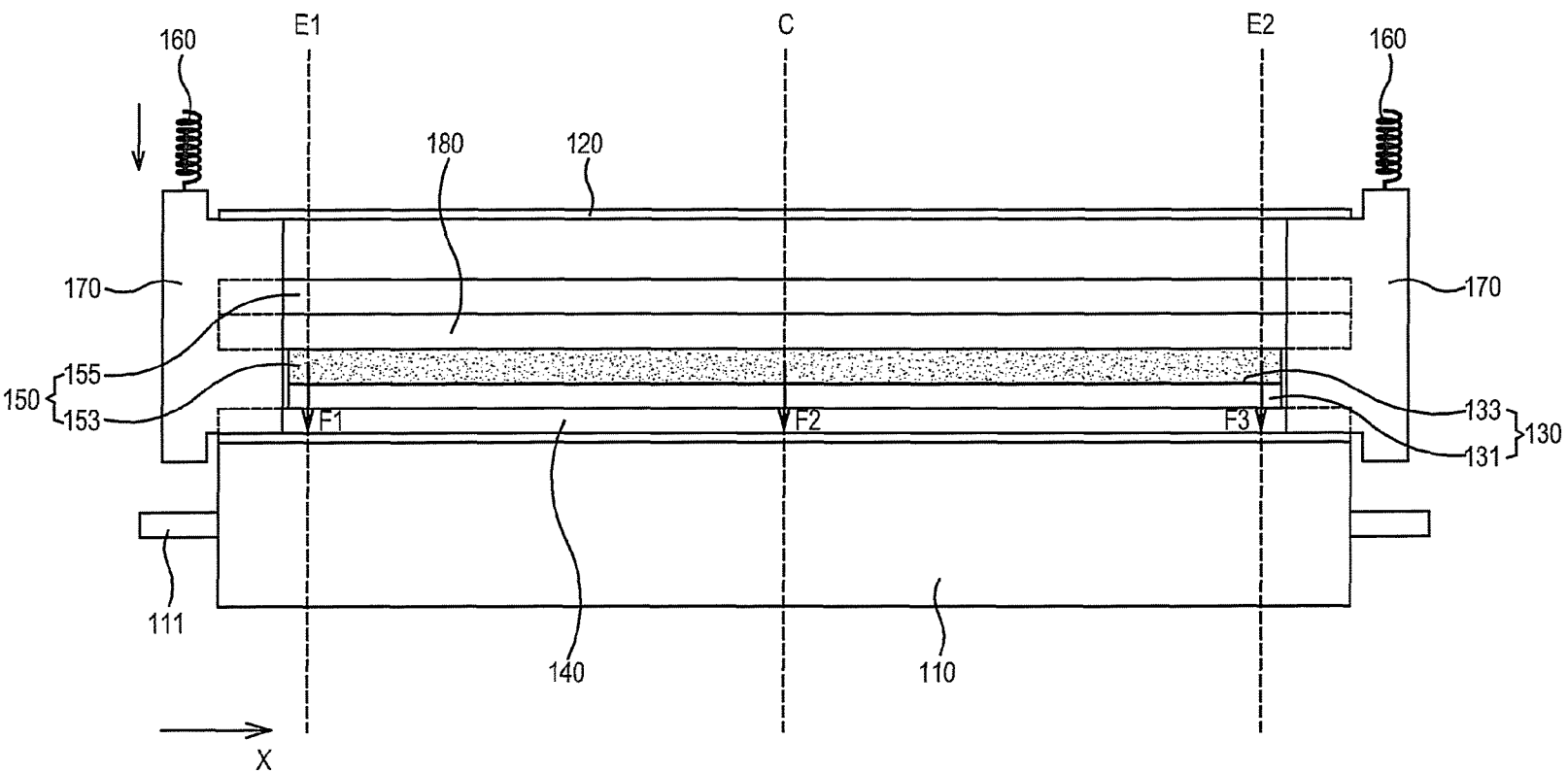
FIG. 5 is a longitudinal section view of the fusing unit in FIG. 4.

As shown in FIGS. 4 and 5, a fusing unit 100 according to an embodiment of the present invention includes a pressing roller 110; a belt 120, which is driven by the pressing roller 110, disposed about a belt guide 125; a nip plate 140, which is disposed along a lengthwise (X) direction of the pressing roller 110 with the belt 120 being disposed therebetween and forms a fusing nip (N); a heat radiating body 130, which is disposed along a lengthwise direction of the nip plate 140 and heats the nip plate 140; and a heat radiating body pressing member 150, which presses the heat radiating body 130 toward the nip plate 140.

The pressing roller 110, which functions as a driving roller, is rotated by a driving unit (not shown). A rotation shaft 111 of the pressing roller 110 is rotatably supported by a frame (not shown). The belt 120 may be provided as an endless belt and may include a base layer which is made of a high molecular weight material such as PI (Polyimide) or PEEK (Polyether Etherketone), a metallic material such as nickel, aluminum or copper, or a metal alloy including the same. On the base layer may be additionally formed an elastic layer or a mold layer.

The nip plate 140 may be made of material having high heat conductivity, such as aluminum, copper or an alloy thereof so that heat from the heat radiating body 130 can be easily conducted thereto.

The heat radiating body 130 includes a substrate 131 which contacts the nip plate 140 and conducts heat to the nip plate 140, and a resistance heat radiating member 133 which is provided on the substrate 131 and radiates heat by resistance.

The resistance heat radiating member 133 is spaced from the nip plate 140 with the substrate 131 being disposed therebetween for electric insulation but need not be limited thereto such that other configurations are available. The substrate 131 may be made of a ceramic material, or alternatively, may be made of a heat conductive material.

The heat radiating body pressing member 150 prevents the heat radiating body 130 from being spaced from the nip plate 140 due to deformation of the substrate 131 as the resistance heat radiating member 133 radiates heat. That is, although the heat radiating body 130 is thermally deformed, the adhesive force between the heat radiating body 130 and the nip plate 140 can be maintained uniformly along the lengthwise direction by the heat radiating body pressing member 150.

The heat radiating body pressing member 150 includes a pressing part 153 which presses the heat radiating body 130 corresponding to the adhesive force between the heat radiating body 130 and the nip plate 140; and a supporting part 155 which is disposed opposite to the heat radiating body 130 with the pressing part 153 being disposed therebetween.

The supporting part 155 is supported by bushings 170 (to be described later) at opposite end parts thereof and supports the pressing part 153. The supporting part 155 may be made of heat proof resin.

The pressing part 153 may press the heat radiating body 130 with different pressing forces along the lengthwise (X) direction corresponding to deformation of the heat radiating body 130 and the nip plate 140. Alternatively, the pressing force may be maintained uniformly in spite of deformation of the heat radiating body 130 if the adhesive force between the heat radiating body 130 and the nip plate 140 is above a predetermined value.

Figure 6A:
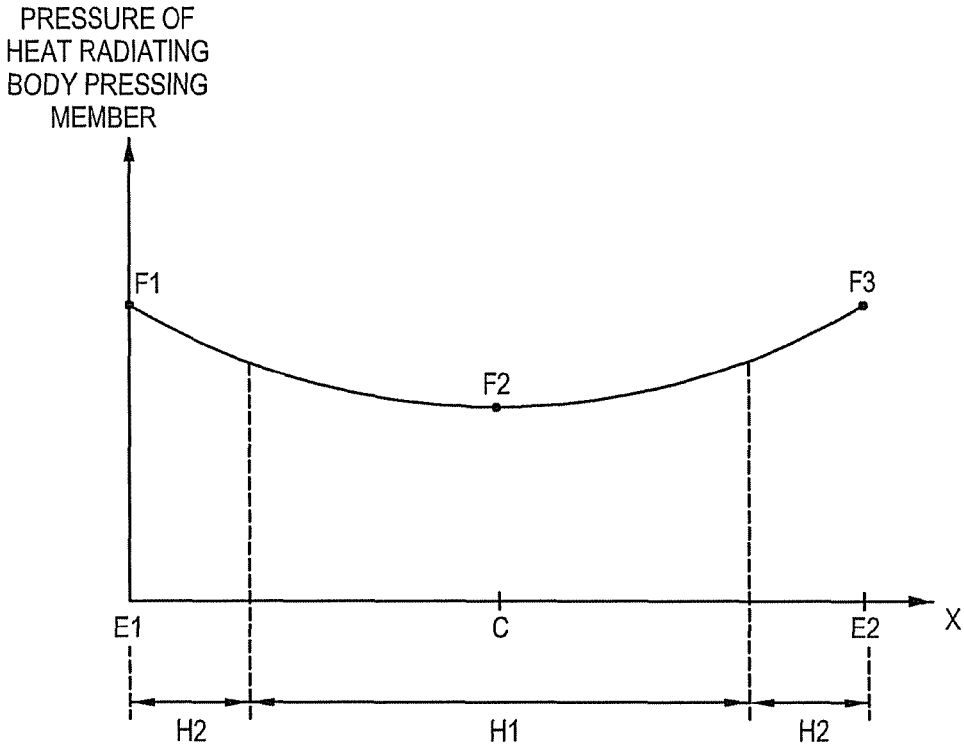
FIG. 6A is a graph showing a pressing force of a heat radiating body pressing member in the fusing unit in FIG. 4.

The heat radiating body pressing member 150 may be provided so that the pressing force thereof can have a distribution as shown in FIG. 6A along the lengthwise (X) direction. That is, the pressing force can be adjusted in consideration of the deformation that the heat radiating body 130 and the nip plate 140 get close to and become spaced from each other.

Referring to FIG. 6A, the heat radiating body 130 and the nip plate 140 deform to get close to each other in a section H1, and deforms to be spaced from each other in a section H2. More specifically, the adhesive force between the heat radiating body 130 and the nip plate 140 in the section H1 is larger than that in the section H2. The adhesive force is largest in the center part (C) in the section H1, and smallest in the opposite end parts (E1 and E2) in the section H2. Accordingly, the pressing force of the heat radiating body pressing member 150 may be adjusted to be larger in the section H2 than in the section H1, as shown in FIG. 6A. The pressing force may be inversely proportional to the adhesive force between the heat radiating body 130 and the nip plate 140, i.e., the pressing force is smallest in the center part (C) where the adhesive force is greatest, and the pressing force is greatest in the opposite end parts (E1 and E2) where the adhesive force is smallest.

Figure 8:
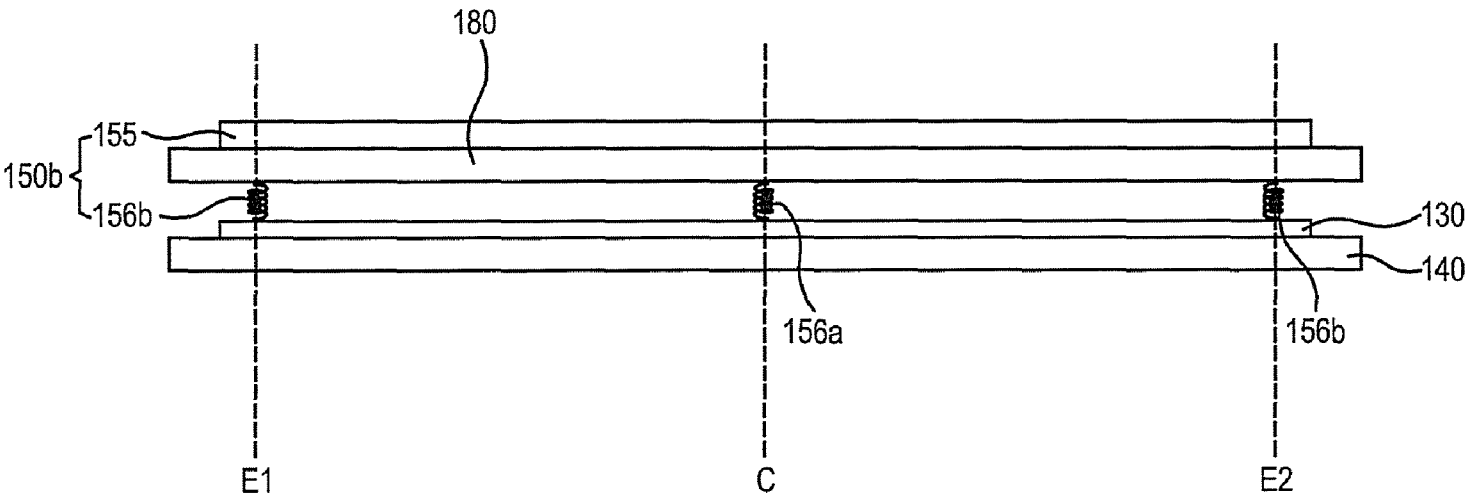
FIG. 8 illustrates still another heat radiating body pressing member in the fusing unit in FIG. 4.

The pressing force distribution as shown in FIG. 6A can be obtained using an elastic member, such as sponge, rubber, or a spring, i.e., the elastic member may sponge, rubber, a spring, or any combination thereof. The elastic member may be differ along the lengthwise (X) direction in at least one of thickness, elastic modulus, or material, i.e., the elastic member may differ along the lengthwise (X) direction in at least one of thickness, elastic modulus, material, or any combination thereof. The elastic member may also be a single elastic member or a plurality of individual elastic members. For example, an elastic member, which is thin in the center part (C) and thick in the opposite end parts (E1 and E2), may be disposed between the supporting part 155 and the nip plate 140, and then pressed. Further, an elastic member including different materials along the lengthwise (X) direction may be disposed instead of or in combination with the elastic member including different thicknesses or elastic moduli along the lengthwise (X) direction. Moreover, the elastic member may include a biasing member or spring, such as a compression coil spring, having different elastic moduli along the lengthwise (X) direction as shown in FIG. 8, instead of or in combination with the sponge and/or the rubber.

Figure 3A:
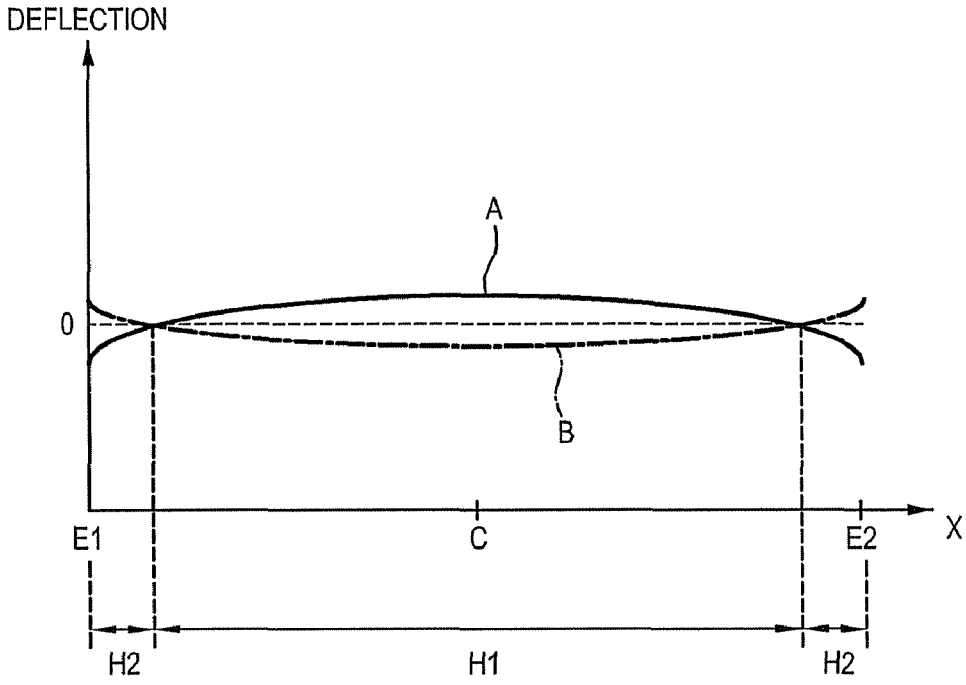
FIG. 3A (RELATED ART)
FIG. 3A is a graph showing deflection along a lengthwise direction of a heat radiating body and a nip plate in the conventional fusing unit.
Figure 3B:
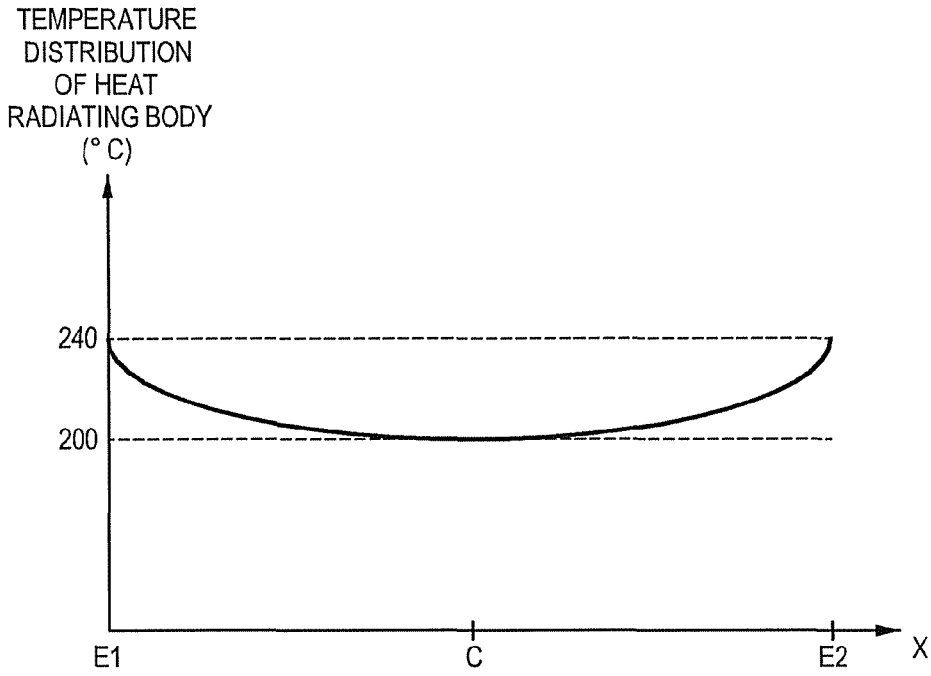
FIG. 3B (RELATED ART)
FIG. 3B is a graph showing temperature distribution along the lengthwise direction of the heat radiating body in the conventional fusing unit.
Figure 6B:
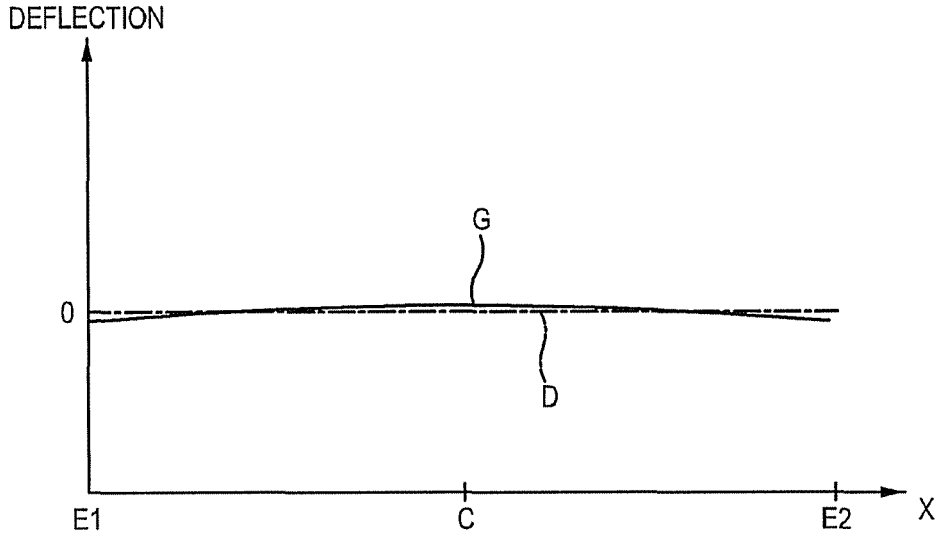
FIG. 6B is a graph showing deflection along a lengthwise direction of a heat radiating body and a nip plate in the fusing unit in FIG. 4.
Figure 6C:
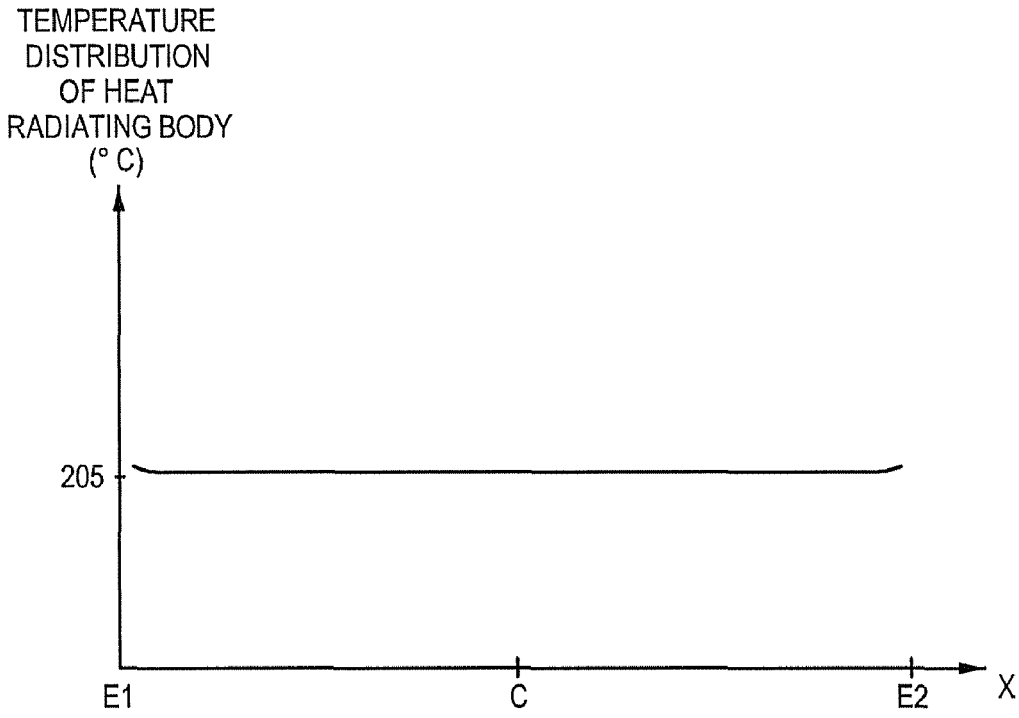
FIG. 6C is a graph showing temperature distribution along the lengthwise direction of the heat radiating body in the fusing unit in FIG. 4.

FIG. 6B is a graph for illustrating deflection of the heat radiating body 130 and the nip plate 140 along the lengthwise (X) direction when the heat radiating body pressing member 150, according to aspects of the present invention, is employed. Comparing FIG. 6B with FIG. 3A, it can be seen that the heat radiating body 130, the deformation of which is represented as a dotted line D in FIG. 6B, is little deformed along the lengthwise (X) direction and the deformation of the nip plate 140, which is represented as a solid line G in FIG. 6B, is significantly decreased along the lengthwise (X) direction. Accordingly, the heat radiating body 130 and the nip plate 140 can be adhered with a relatively uniform adhesive force along the lengthwise (X) direction. As a result and as shown in FIG. 6C, the heat radiating body 130 can maintain a nearly uniform fusing temperature of about 205° C. along the lengthwise (X) direction.

The fusing unit 100 according to aspects of the present invention may further include a heat insulating member 180. The heat insulating member 180 is disposed between the pressing part 153 and the supporting part 155 and prevents heat from the heat radiating body 130 from being transferred to the supporting part 155, as shown in FIG. 5. The fusing unit 100 may further include a pair of bushings 170, which rotatably support opposite end parts of the belt 120 and support opposite end parts of the heat radiating body pressing member 150; and a bushing pressing member 160, which elastically presses the bushings 170 toward the pressing roller 110, as shown in FIG. 5.

Figure 7:
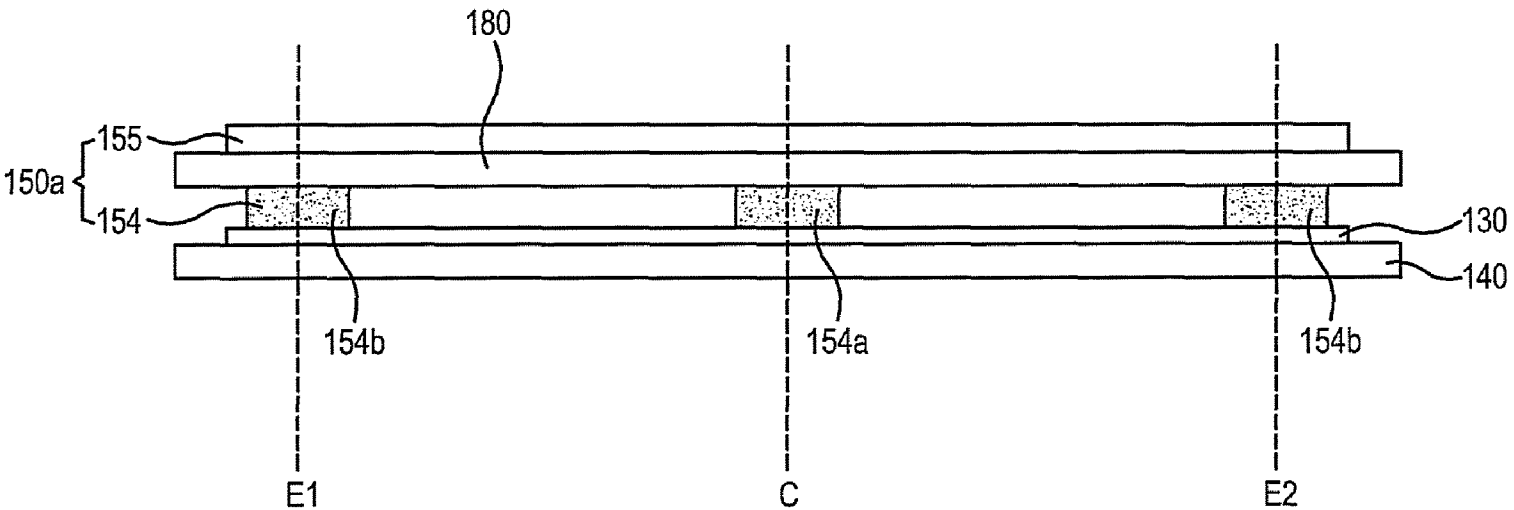
FIG. 7 illustrates another heat radiating body pressing member in the fusing unit in FIG. 4.

FIG. 7 illustrates another heat radiating body pressing member 150*a* according to aspects of the present invention. The heat radiating body pressing member 150*a* includes a pressing part 154 and a supporting part 155. The pressing part 154 includes a pressing part 154*a* which is disposed in the center part (C); and a pair of pressing parts 154*b* which are disposed in the opposite end parts (E1 and E2). Pressing forces of the pressing parts 154*b* may be different as necessary.

The pressing part 154 may locally press or contact the heat radiating body 130 only at the center part (C) and at the opposite end parts (E1 and E2) thereof, unlike the above-described pressing part 153. The pressing part 154*a* in the center part (C) may be made of a more flexible material than the pressing parts 154*b* in the opposite end parts (E1 and E2), or the pressing part 154*a* may be made of an elastic material having a thickness thinner than the pressing parts 154*b*, so as to provide different pressing forces along the lengthwise direction of the heat radiating body 130. Although the pressing part 154 is illustrated as comprising the pressing parts 154*a* and 154*b*, the pressing part 154 is not limited thereto such that the pressing part 154 may comprise a plurality of individual pressing parts disposed along the lengthwise direction (X) to apply different forces to the heat radiating body 130 along the lengthwise direction (X). Specifically, the pressing part 154 may include a plurality of individual pressing parts disposed between the opposite ends (E1 and E2) and the center (C) of the heat radiating body 130 along the lengthwise direction (X) to apply a first force at the opposite ends (E1 and E2) greater than a second forces at the center (C) and additional forces to the heat radiating body 130, the additional forces being of a magnitude less than the first force and greater than the second force FIG. 8 illustrates still another heat radiating body pressing member 150*b* according to aspects of the present invention. The heat radiating body pressing member 150*b* includes a pressing part 156 and a supporting part 157. The pressing part 156 may include three biasing members 156*a* and 156*b*. The biasing members 156*a* and 156*b* may be compression coil springs. Here, the biasing members 156*a* and 156*b* may have different elastic moduli. For example, the elastic modulus of the biasing members 156*b* in the opposite end parts (E1 and E2) may be larger than that of the biasing member 156*a* in the center part (C).

Figure 9:
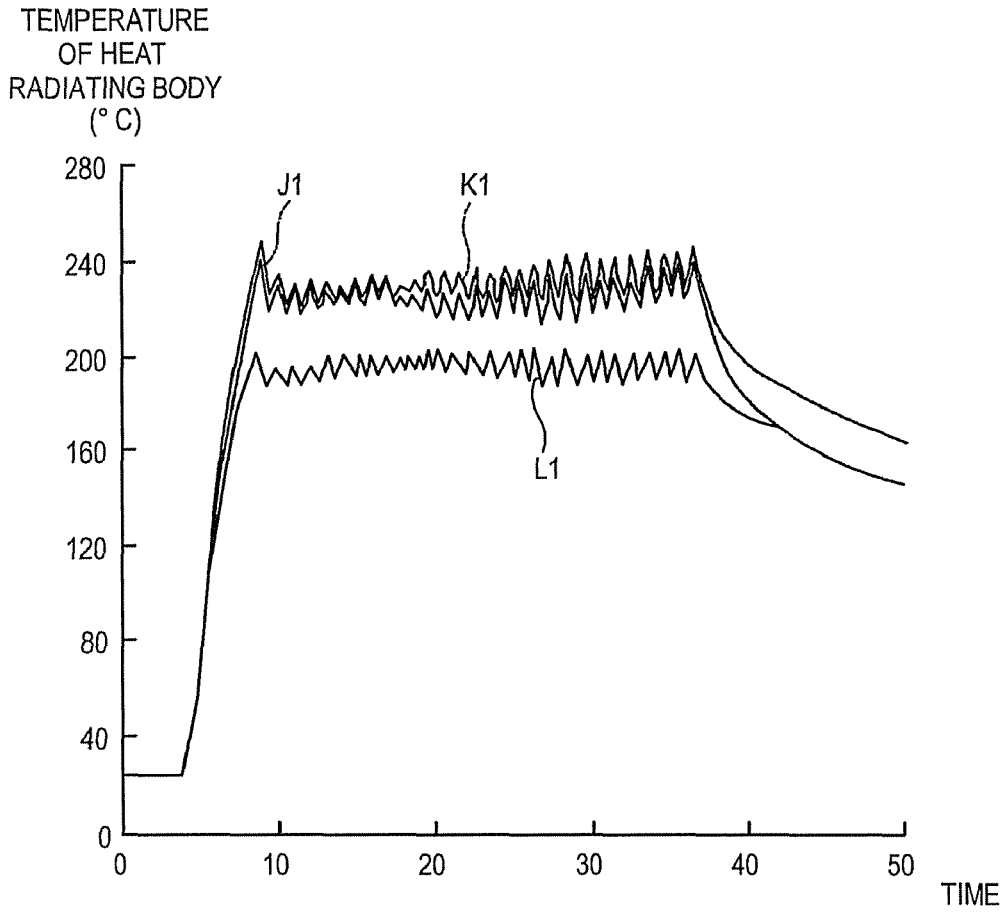
FIG. 9 (RELATED ART)
FIG. 9 is a graph showing a temperature change of the heat radiating body in the conventional fusing unit in FIG. 1.
Figure 10:
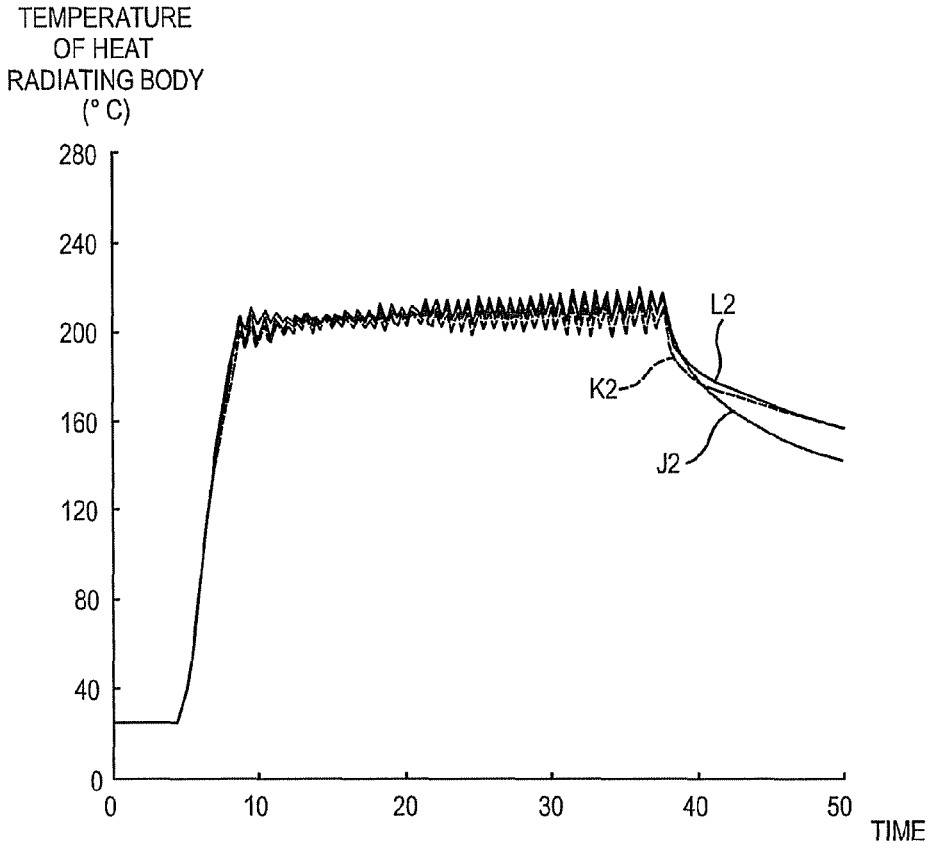
FIG. 10 is a graph showing a temperature change of the heat radiating body in the fusing unit in FIG. 4.

FIGS. 9 and 10 illustrate experimental results representing a temperature change at predetermined points of the lengthwise direction in the conventional fusing unit 1 and the fusing unit 100 according to aspects of the present invention, respectively. If power is applied to the resistance heat radiating member, the temperature of the heat radiating member rises to a fusing temperature of 200° C.

Experimental conditions of the fusing unit according to aspects of the present invention are as follows: the bushing pressing member 160 has an elastic force of 4.0 kgf; the nip plate 140 is made of phosphor bronze and has a thickness of 0.5 mm; the heat radiating body 130 includes the substrate 131 formed of ceramic and the resistance heat radiating member 133 has a resistance of 60Ω. Further, three compression coil springs of 900 gf, 700 gf and 900 gf are sequentially arranged in the points E1, C and E2.

Curves J1, L1 and K1 in FIG. 9 respectively represent temperature changes of the conventional heat radiating body 30 at the points E1, C and E2 in FIG. 8; and curves J2, L2 and K2 in FIG. 10 respectively represent temperature changes of the heat radiating body 130 according to aspects of the present invention at the points E1, C and E2 in FIG. 8.

As shown in FIG. 9, in the conventional fusing unit 1, temperature difference between the curves J1 and K1 and the curve L1 is about 40° C., and accordingly, the temperature of the opposite end parts (E1 and E2) is about 20% higher than that of the center part (C).

Thus, the opposite end parts are overheated, whereas the center part maintains a normal fusing temperature (180-220° C.) if a temperature sensor is provided at the center part (C) for temperature control. In order to prevent overheating in the opposite end parts, an additional sensor should be provided at the opposite end parts for temperature control. Even if the additional sensor is provided at the opposite end parts to maintain the temperature of the opposite end parts normal, the temperature of the center part may be less than the normal fusing temperature. Therefore, it is difficult to control the fusing temperature uniformly over the whole length of the heat radiating body 30.

In contrast, in the fusing unit 100 according to aspects of the present invention, temperature difference between the curves J2 and K2 and the curve L2 is under 10° C., as shown in FIG. 10. Thus, in the fusing unit 100 according to aspects of the present invention, the fusing temperature of the heat radiating body 130 can be maintained nearly uniformly over the whole length thereof by means of the heat radiating body pressing member 150. Accordingly, wherever the temperature sensor for temperature control is disposed, the temperature of the heat radiating body 130 can be suitably controlled, and the fusing unit 100 is not bound by an arrangement of the temperature sensor. Further, the overheating of the heat radiating body 130 can be prevented even with a single temperature sensor.

An image forming apparatus according to aspects of the present invention includes an image forming unit (not shown) which forms an image on a printing medium with a developer; and the fusing unit 100 to fuse the developer on the printing medium.

The image forming unit may include an image supporting body (not shown) on which an electrostatic latent image is formed; a developing unit (not shown) which develops the electrostatic latent image with a developer to form a visible image on the image supporting body; and a transferring unit which is disposed opposite to the image supporting body with a printing medium being disposed therebetween and transfers the visible image to the printing medium. The image supporting body may be provided as an organic photosensitive drum, or alternatively, as an imaging drum on which a plurality of electrodes are arranged.

The fusing unit and the image forming apparatus according to aspects of the present invention as described above have the following effects. First, an adhesive force between the heat radiating body and the nip plate can be maintained uniformly. Second, thermal deformation of the heat radiating body can be minimized. Third, temperature of the heat radiating body and the nip plate can be maintained uniformly along the lengthwise direction thereof, thereby removing the limit to an arrangement of a temperature sensor or multiple temperature sensors. Fourth, a fusing temperature can be maintained uniformly, thereby enhancing the printing quality.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing unit, comprising:

a driving roller;

a belt disposed to be driven by the driving roller;

a nip plate disposed along a lengthwise direction of the driving roller with the belt disposed between the driving roller and the nip plate, the nip plate being pressed toward the driving roller to form a fusing nip;

a heat radiating body disposed along the lengthwise direction to heat the nip plate by heat conduction; and a heat radiating body pressing member to press the heat radiating body toward the nip plate to prevent the heat radiating body from being spaced from the nip plate due to thermal deformation, wherein the heat radiating body pressing member differs along the lengthwise direction in at least one of thickness, elastic modulus, and material.

2. The fusing unit according to claim 1, wherein the heat radiating body pressing member presses the heat radiating body with different pressing forces along the lengthwise direction corresponding to thermal deformation of the heat radiating body and the nip plate along the lengthwise direction.

3. The fusing unit according to claim 1, wherein the heat radiating body pressing member comprises:

a pressing part to elastically press the heat radiating body toward the nip plate; and a supporting part disposed opposite the heat radiating body from the nip plate to support the pressing part with the pressing part being disposed between the nip plate and the supporting part.

4. The fusing unit according to claim 3, further comprising:

a bushing to rotatably support the belt and to support the heat radiating body pressing member; and a bushing pressing member to elastically press the bushing toward the driving roller.

5. The fusing unit according to claim 4, further comprising:

a heat insulating member disposed between the supporting part and the heat radiating body to prevent heat from the heat radiating body from being transferred to the supporting part.

6. The fusing unit according to claim 1, wherein the heat radiating body pressing member comprises at least one of sponge, rubber, and a spring.

7. An image forming apparatus, comprising:

an image forming unit to forms an image on a printing medium with a developer; and the fusing unit according to claim 1 to fuse the image on the printing medium.

8. The image forming apparatus according to claim 7, wherein the heat radiating body pressing member presses the heat radiating body with different pressing forces along the lengthwise direction corresponding to thermal deformation of the heat radiating body and the nip plate along the lengthwise direction.

9. The image forming apparatus according to claim 7, wherein the heat radiating body pressing member comprises:

a pressing part to elastically press the heat radiating body toward the nip plate; and a supporting part disposed opposite the heat radiating body from the nip plate with the pressing part being disposed between the nip plate and the supporting part.

10. The image forming apparatus according to claim 7, wherein the heat radiating body pressing member comprises at least one of sponge, rubber, and a spring.

11. A fusing unit, comprising:

a belt disposed to rotate about a belt guide;

a driving roller disposed to rotate the belt about the belt guide;

a nip plate disposed along a lengthwise direction of the driving roller to press the belt toward the driving roller to form a fusing nip between the belt and the driving roller;

a heat radiating body disposed to heat the nip plate by heat conduction; and a heat radiating body pressing member to press the heat radiating body toward the nip plate with a first force at ends of the heat radiating body greater than a second force at a center of the heat radiating body, wherein the heat radiating body pressing member differs along the lengthwise direction in at least one of thickness, elastic modulus, and material.

12. The fusing unit of claim 11, wherein the heat radiating body pressing member applies additional forces between the ends and center of the heat radiating body, the additional forces being of a magnitude less than the first force and greater than the second force.

13. The fusing unit of claim 11, wherein the heat radiating body pressing member comprises:

a pressing part disposed to apply the first and second forces to the heat radiating body; and a supporting part disposed to support the pressing part.

14. The fusing unit of claim 13, wherein the pressing part comprises a plurality of individual pressing parts disposed along the lengthwise direction to apply the first and second forces and additional forces to the heat radiating body, the additional forces being of a magnitude less than the first force and greater than the second force.

15. The fusing unit of claim 13, wherein the pressing part comprises:

first pressing parts disposed at the ends of the heat radiating body; and a second pressing part disposed at the center of the heat radiating body.

16. The fusing unit of claim 15, wherein the first and second pressing parts are biasing members.

17. The fusing unit of claim 15, wherein the first pressing parts have a thickness greater than a thickness of the second pressing part.

18. The fusing unit of claim 15, wherein the first pressing parts have an elastic modulus less than an elastic modulus of the second pressing part.

19. A fusing unit, comprising:

a belt disposed to rotate about a belt guide;

a driving roller disposed to rotate the belt about the belt guide;

a nip plate disposed along a lengthwise direction of the driving roller to press the belt toward the driving roller to form a fusing nip between the belt and the driving roller;

a heat radiating body disposed to heat the nip plate by heat conduction; and a heat radiating body pressing member to press the heat radiating body toward the nip plate with forces inversely proportional to an adhesive force between the heat radiating body and the nip plate at a point therebetween, wherein the heat radiating body pressing member differs along the lengthwise direction in at least one of thickness, elastic modulus, and material.

* * * * *